US007544913B2

(12) United States Patent
Helenius et al.

(10) Patent No.: US 7,544,913 B2
(45) Date of Patent: Jun. 9, 2009

(54) COOLED PLASMA TORCH AND METHOD FOR COOLING THE TORCH

(75) Inventors: Pekka Helenius, Kirkkonummi (FI); Kari Ahola, Klaukkala (FI)

(73) Assignee: Tomion Oy, Klaukkala (FI)

( * ) Notice: Subject to any disclaimer, the term of this patent is extended or adjusted under 35 U.S.C. 154(b) by 0 days.

(21) Appl. No.: 10/572,103

(22) PCT Filed: Sep. 17, 2004

(86) PCT No.: PCT/FI2004/000547

§ 371 (c)(1),
(2), (4) Date: Mar. 15, 2006

(87) PCT Pub. No.: WO2005/027594

PCT Pub. Date: Mar. 24, 2005

(65) Prior Publication Data

US 2006/0289406 A1 Dec. 28, 2006

(30) Foreign Application Priority Data

Sep. 17, 2003 (FI) ..... 20031331

(51) Int. Cl.
*H05B 1/02* (2006.01)

(52) U.S. Cl. ..... 219/121.49; 219/121.51; 219/121.48; 313/231.31

(58) Field of Classification Search ..... 219/121.36, 219/121.48, 121.49, 121.52, 121.51, 121.54, 219/74, 75, 121.39, 121.45, 121.46; 313/231.31, 313/231.41
See application file for complete search history.

(56) References Cited

U.S. PATENT DOCUMENTS

| | | | | |
|---|---|---|---|---|
| 3,217,133 | A | 11/1965 | Mattmuller | |
| 3,319,097 | A | 5/1967 | Giannini et al. | |
| 6,005,221 | A * | 12/1999 | Cusick, III | 219/137.62 |
| 6,385,977 | B1 * | 5/2002 | Johnson | 62/64 |
| 6,586,708 | B1 | 7/2003 | Cusick, III | |
| 6,689,983 | B2 * | 2/2004 | Horner-Richardson et al. | 219/121.39 |
| 6,752,972 | B1 * | 6/2004 | Fraim et al. | 422/198 |

FOREIGN PATENT DOCUMENTS

| | | |
|---|---|---|
| EP | 0 640 426 | 3/1995 |

* cited by examiner

*Primary Examiner*—Mark H Paschall
(74) *Attorney, Agent, or Firm*—Smith-Hill and Bedell P.C.

(57) ABSTRACT

The invention relates to a cooled plasma torch comprising an electrode, a plasma chamber surrounding the electrode, and a coolant space surrounding the plasma chamber with at least one common wall with the plasma chamber. The plasma torch further comprises means for feeding a coolant medium into the coolant space. The coolant medium pressure is reduced in a fashion that causes a phase change in the coolant medium as it is passed from the coolant feed means to the coolant space, whereby the plasma torch is cooled.

12 Claims, 2 Drawing Sheets

COOLED PLASMA TORCH AND METHOD FOR COOLING THE TORCH

This is a national stage application filed under 35 USC 371 based on International Application No. PCT/FI2004/000547 filed Sep. 17, 2004, and claims priority under 35 USC 119 of Finnish Patent Application No. 20031331 filed Sep. 17, 2003.

The present invention relates to a cooled plasma torch.

In a plasma torch, the so-called main arc used for welding is struck between the torch electrode and a workpiece. The nozzle portion of the torch comprises two coaxial chambers. The inner chamber houses a tungsten electrode centered in the plasma gas chamber, while the chamber end is provided with an exit orifice at the electrode tip. The plasma gas is fed into this chamber. The inner chamber is surrounded by a second chamber exiting concentrically about the orifice of the inner chamber. A shield gas flow providing a sheath about the plasma arc is fed into the outer chamber.

Inasmuch as the arc of a plasma torch burns in a gas flowing over the gap between the workpiece and the torch electrode, the gas must be ionized prior to the ignition of the main arc in order to make the gas conductive. The ionization of the plasma gas is effected with the help of a pilot arc struck between the center electrode and the nozzle piece delineating the inner chamber and center electrode. The pilot arc ionizes the flowing plasma gas, whereby between the workpiece and the electrode is established a conductive ionized path along which the main arc can be struck.

The main arc may be struck only between the electrode and the workpiece, since a high-energy arc striking between the electrode and the nozzle destroys the nozzle very rapidly. Conventionally, the nozzle cooling arrangement and the electrical/magnetic forces established in the torch geometry prevent the main arc from being struck between the electrode and the nozzle. However, the electrode tip must herein be aligned precisely with the electrical center of the nozzle. If the nozzle exit orifice and the electrode tip are fully symmetrical, the electrical center generally also coincides with the geometrical center.

Even in smaller torches, plasma arc welding runs at relatively high currents, whereby current density in the electrical components of the torch is high. The high current density causes heating of the electrical parts in the torch tip. The end portion and the shield cup of the torch are respectively subjected to aggressive heating by the plasma arc. To withstand the high thermal stress, plasma torches are generally cooled with water circulating in the upper end of the plasma torch nozzle thus cooling the electrical components thereof and, via them, the shield cup, whereby the water circulation is adapted to extend maximally distally in regard to the torch tip. Inasmuch as the object of cooling of the torch tip is to prevent the plasma arc from causing excessive temperature rise at the tip, the circulating water should reach as close as possible to the torch tip. Obviously, this is the more difficult to implement the smaller the nozzle dimensions.

In U.S. Pat. No. 5,208,442 is disclosed a water-cooled plasma torch with a cooling arrangement wherein cooling water is passed via hoses to the coolant chambers of the torch. The torch body portion made from an epoxy resin is extended so as form a handle that houses the necessary electrical, gas and coolant conduits. Inside the torch handle is mounted a water-cooled upper body piece of the torch head housing a bearing socket suited to accommodate an adjustable spherically-contoured electrode holder. The current connection to the center electrode is via the upper end of the torch body, whereto current is passed along a conductor. At the torch upper end housing the bearing socket, the torch body cavity is provided with an insulator bushing faced on one side by the water-cooled lower body piece of the torch. Another current connection to the lower body piece is via a conductor, whereby current is passed via the lower body piece to a plasma nozzle attached to the tip thereof. The above components comprise the electrical circuit for the pilot arc initiated between the nozzle and the torch electrode. At the torch tip, the plasma torch is surrounded by a ceramic shield cup mounted on the torch body by a threaded bushing. If desired, a baffle making the gas flow laminar can be placed in the annular gap remaining between the shield cup and the lower body piece.

The cooling water is passed to the upper torch body portion via an inlet hose, whereupon the coolant first circulates in the water space of the upper body portion and therefrom further to the lower body portion of the torch made of a polymer or other nonconducting material, where the coolant circulates in the water space of the lower body portion and exits via an outlet hose. Hence, such an embodiment requires four hose connections that are difficult to make leakproof without a great effort. A design constraint of this construction is that the upper body portion of the torch must be electrically insulated from the lower body portion and the plasma torch nozzle. The plasma nozzle piece is mounted on the lower body portion of the torch thus allowing indirect cooling of the nozzle piece by conducting heat from the nozzle piece to the lower body portion of the torch and therefrom into the water circulating therein. Inasmuch as the cross-sectional area of the heat-transmitting component limits the efficiency of thermal transfer capacity, the temperature of the plasma torch tip may resultingly rise excessively high. Moreover, this kind of torch construction is relatively complicated and expensive to manufacture due to the large number of its components and connections, whereby a good thermal conductivity of the joints between the components must be assured by precision machining in order to obtain maximally large area of mating surfaces with a good thermal transfer capacity.

Obviously, the cooling arrangements of different plasma torch embodiments vary in spite of the common features thereof, such as the above-described separate water spaces and the multiple unions of the coolant channels supporting the circulation of the cooling water. Due to their complicated structure, conventional plasma torches are costly and their assembly is a tedious manual operation requiring high precision to assure the leakproofness of the coolant conduits. Furthermore, no really functional effective cooling technique of a plasma torch has been devised in the art inasmuch as extending a coolant space in the torch close to the nozzle tip is very difficult especially in small torches.

It is an object of the present invention to provide a plasma torch with effective cooling of the plasma torch tip without using circulating water as a coolant.

The goal of the invention is achieved by virtue of cooling the plasma torch tip with the help of coolant undergoing a phase change.

More specifically, the plasma torch according to the invention is characterized by what is stated in the characterizing part of claim 1.

Furthermore, the cooling method according to the invention is characterized by what is stated in the characterizing part of claim 10.

The invention offers significant benefits.

Obviously the most significant virtue of the invention is an essentially simpler construction of a plasma torch. This benefit has multiple effects on the reliability and cost of the plasma torch. Inasmuch as the torch operates without any coolant circulation, not the least amount of a liquid can reach the melt at any instant. During operation, the leakproofness of the plasma torch can be secured reliably and, in the rare case of a leak, the liquefied medium used as the evaporating coolant cannot spoil the weld as the coolant is rapidly evaporated to the environment. The amount of coolant used in the torch is small thus having no impact on the environment. Furthermore, the coolant materials employed in the invention are harmless to the environment. The plasma torch can be designed very small and lightweight thus making it easy to handle. With such a small torch, plasma-arc welding can be used even in such applications that in the prior art have required expensive special equipment to produce welds. These applications include precision mechanics production and jewelry equipment. Inasmuch as the torch cable carries no coolant feed/return hoses, the cable can be made thin and flexible, which is further benefit contributing to the easy handling of the plasma torch. In addition to the welding equipment power supply, the operation of the plasma torch only needs a compressed gas cylinder of a convenient size, whereby moving and handling the entire welding equipment is uncomplicated.

By virtue of a coolant phase change, an extremely high temperature gradient can be created at the torch tip between the torch tip cooling space and the exterior space under the torch tip that is heated by the plasma arc and the melt. Resultingly, the torch tip remains very cool, whereby molten metal or additive droplets splashing from the melt do not adhere to the torch tip. This makes it possible to work extremely close to the workpiece and the melt. The closer the torch to the workpiece, the less heat is applied to the workpiece and the easier it is to control the melt behavior. The heat transfer efficiency of the novel coolant phase-change arrangement is high when adapted to the tip of a maximally lightweight plasma torch tip.

Nevertheless that the coolant in the preferred embodiment of the invention is a gas, which is allowed to escape from the plasma torch to the ambient air, the cost of gas consumption remains moderate inasmuch as the required flow rate of the cooling gas is rather low. The cooling gas can be selected from the group of inert gases such as argon or helium or, advantageously, food-grade carbon dioxide may be used. As a coolant, carbon dioxide has suitable properties and is cost-advantageous. Moreover, rare gases in liquefied form may have a limited availability and their prices tend to be high.

In the following, the invention is described in more detail by making reference to the appended drawings in which FIG. 1 shows an embodiment of a plasma torch electrode holder;

Figure 1:
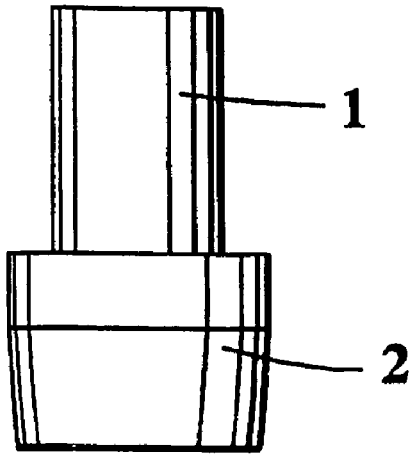
Figure 2:
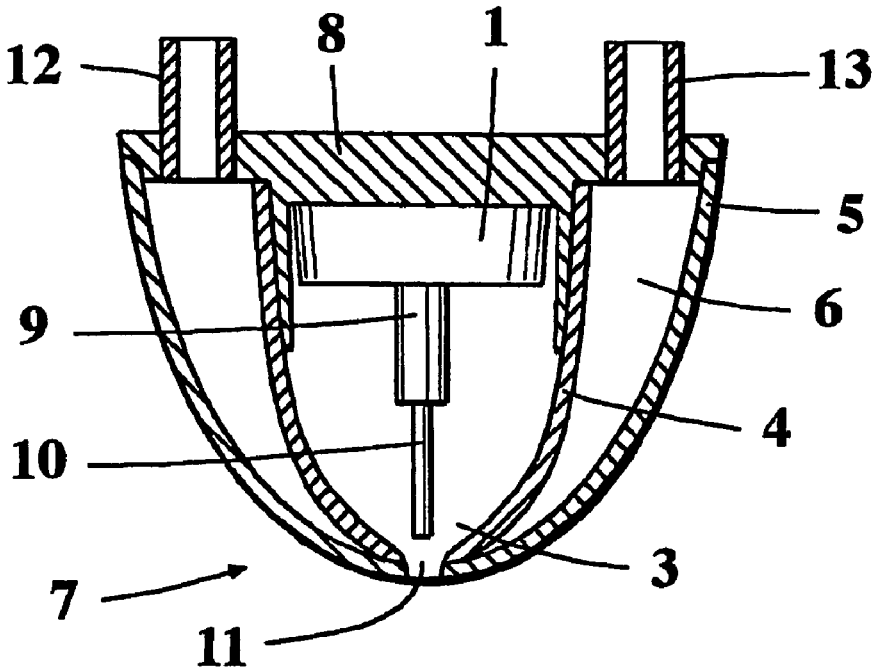
FIG. 2 shows a cross-sectional view of a plasma torch tip portion according to one embodiment of the invention.

Referring to FIG. 1, a plasma torch electrode holder 1 is shown therein. Electrode holder 1 has a conical section 2 serving to adapt holder 1 into the conically tapered center bore of the plasma torch nozzle. The plasma torch nozzle shown in FIG. 2 comprises a plasma chamber 3 delineated by an inner cone 4. The inner cone 4 is surrounded by an outer cone 5, whereby a coolant space 6 remains therebetween. As to the conical spaces of the plasma torch nozzle 7, they are closed at the conical section's upper end by an insulator 8. The insulator is made of, e.g., silicone or PEEK polymer. The electrode holder 1 is fixed to the insulator 8 and, by virtue of making the thickness of insulator 8 in the gap between plasma torch nozzle 7 and the electrode holder very small, the inner cone 4 can perform effective cooling of electrode holder 1. Mounted in an electrode bushing 9, electrode holder 1 supports an electrode 10 having the tip thereof aligned at an orifice hole made in plasma torch nozzle in order to strike a plasma arc therein. The size of the plasma arc orifice hole may be varied, e.g., being drilled in a series of different diameters of 0.3, 0.6, 0.9, 1.2, 1.5, 1.8 and 2.1 mm. Advantageously, the plasma torch nozzle is made from copper with small wall thicknesses to secure good heat transfer. The torch nozzle walls should be 0.2 to 0.5 mm thick, whereby the nozzle tip thickness may be max. 1.0 mm thick. Inasmuch as an extremely large temperature difference is established between the plasma torch coolant space and the hot plasma, a very good efficiency of the cooling arrangement can be attained.

Figure 3:
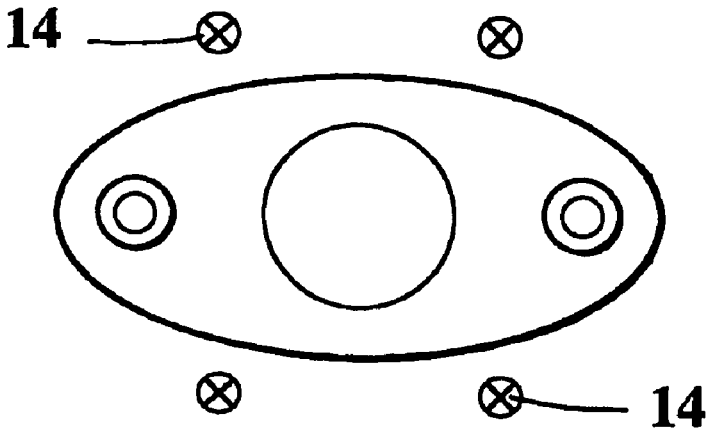
FIG. 3 shows a partially cross-sectional view of the plasma torch tip of FIG. 2.

A coolant inlet duct 12 enters the coolant space 3, while an outlet line 13 duct respectively projects from the opposite side of the coolant space. In the exemplifying embodiment described herein, the plasma torch nozzle 7 has an oval shape, whereby the coolant is introduced into the coolant space 3 at the shorter sides of the oval shape (cf. FIG. 3). FIG. 3 is further illustrates diagrammatically four ducts 14 placed on the broader sides of the plasma torch nozzle 7 for feeding shield gas and, if necessary, a powder additive about the plasma torch electrode and therefrom into the weld being made.

Figure 4:
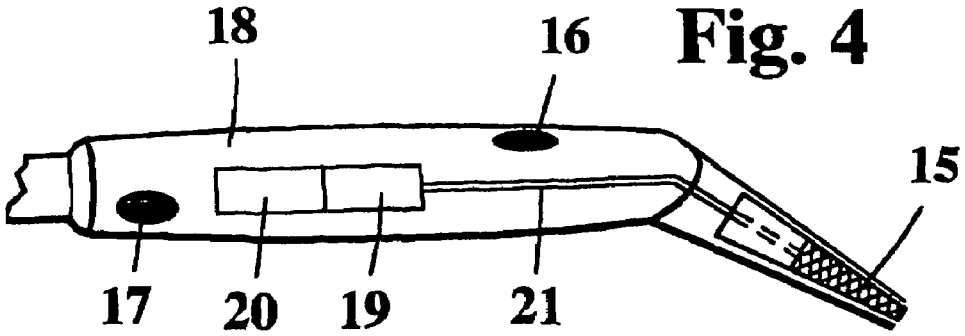
FIG. 4 shows diagrammatically an embodiment of a plasma torch according to the invention in a view illustrating the functional elements concealed in the torch handle.
Figure 5:
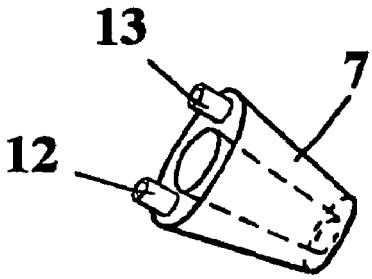
FIG. 5 shows an embodiment of a plasma nozzle used in a plasma torch according to the invention.

FIG. 4 shows a general view of the plasma torch. Situated at the plasma torch tip is a shield gas cup 15 surrounding the above-mentioned plasma torch nozzle 7. The torch handle incorporates a main arc control switch 16 serving to control the ignition/continuation of the main arc, as well as a gas flow control switch for setting on/off the infeed flows of the shield gas, the plasma gas and the coolant into a ready-to-weld status. An essential component in the invention is a valve 19 that is housed inside the torch handle 18 and is adapted operable by a control motor 20. From the valve 19 is passed a coolant duct 21 to the plasma torch nozzle. Inasmuch as the cooling system must function immediately after the pilot arc strikes, the coolant must be introduced to the plasma torch in a liquid phase and, hence, under pressure, whereby the valve 19 must be placed as close as possible to the evaporation nozzle in a fashion to be described later in more detail. Placing the valve to operate in conjunction with, e.g., the power supply, initial filling of the coolant hose with the liquid coolant would take a long time and thus impede the start-up of the plasma arc at the torch. Hence, such an arrangement would result in rather awkward operation of the torch. Now having an integral valve incorporated in the torch, the pilot arc can be ignited without delay. Such rapid start-up of welding wherein the main arc can be struck immediately after the pilot arc has been ignited makes the use of the torch rapid and easy. At the extinction of the pilot arc, also the coolant flow must be cut off quickly inasmuch as the lightweight structure of the torch cannot store heat which means that the torch would cool down rapidly after no thermal energy is any more inflicted on the torch nozzle.

Figure 6:
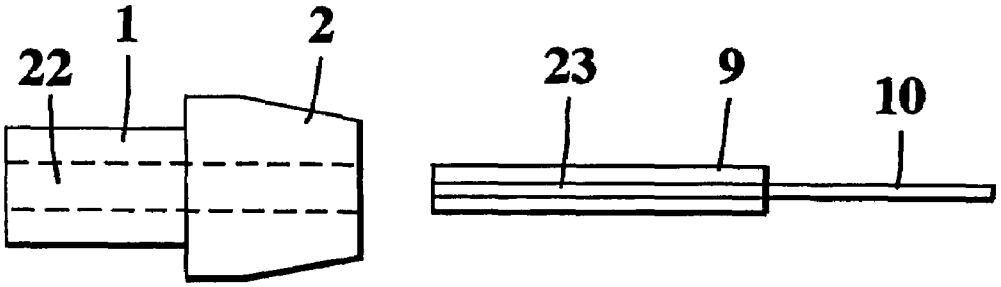
FIG. 6 shows an embodiment of an electrode holder with the electrode.

In FIG. 6 is shown an electrode holder 1 and an electrode 10 inserted in an electrode bushing 9. The electrode holder has a bore 22 for insertion of the electrode sub-assembly 23. The bore 22 also functions as a plasma gas flow channel. Onto the outer surface of the electrode bushing 9 is machined a groove 23 that forms the plasma gas flow channel in close contact to the bore 22 of electrode holder 1. To adapt the plasma torch for different welding jobs, the plasma gas flow rate must be made adjustable. This is accomplished by changing a different electrode 10 with its electrode bushing 9. The electrode bushings 9 may be produced in two types, e.g., one bushing type equipped a broad flow groove 23 producing a narrow and penetrating plasma arc for operations requiring a good penetration capability and another type of bushing 9 with a narrower groove limiting the plasma gas flow rate thus giving a softer and wider plasma arc. Using special depth gauges, the electrodes are inserted in place to a given depth which in the exemplary embodiment of a plasma torch in accordance of the present invention sets the electrode tip spacing to 2 mm from the plasma nozzle exit orifice 11 for a penetrating plasma arc and to 0.3 mm for a soft plasma arc. Advantageously, the diameters of electrodes 10 are 1.0 mm and 1.6 mm, and they are made of tungsten and fixed by crimping or welding to a copper electrode bushing 9. The electrode bushing 9 may be color-coded for easy identification of the electrodes, whereby an electrode giving a deep-penetrating arc can have a black color code, while the soft-arc electrode is coded with a red color.

Figure 7:
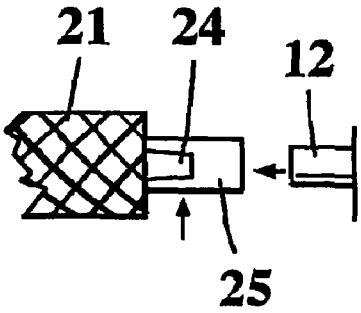
FIG. 7 shows an embodiment of the evaporation nozzle used in the invention.
Figure 8:
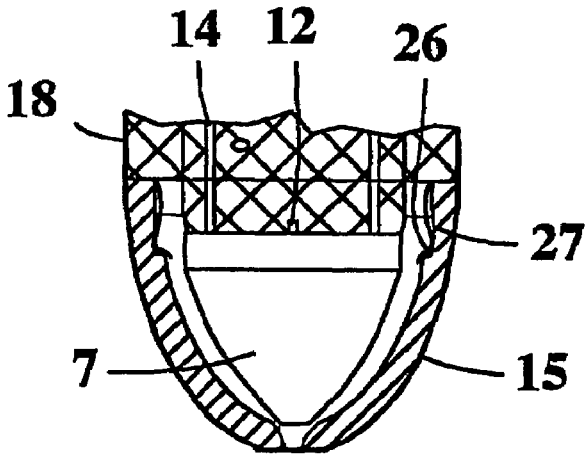
FIG. 8 shows a cross-sectional view of a plasma torch embodiment according to the invention.

In FIG. 7 is shown an evaporation nozzle 24 and its connection to the plasma torch handle. Adapted to the torch handle 18, the coolant inlet duct 21 is a stainless-steel pipe with 1.6/1.2 mm ID/OD. In the silicone insulator of the torch handle, the duct 21 ends at an opening 25 with an inner diameter of 2 mm. At the end of the coolant duct 21 is placed an evaporation nozzle 24 having at its end an exit orifice with an inner diameter of 1.0-0.08 mm. While the exit orifice diameter of the evaporation nozzle is not essential, it must be selected such that sufficient flow constriction and pressure drop are attained in the evaporation nozzle to cause immediate coolant evaporation at the immediate exit from the nozzle. Advantageously, the exit orifice of the evaporation nozzle can be made using a conventional jewel bearing which is precision-drilled to a small diameter as is necessary in the clock manufacturing industry. The exit orifice diameter of the evaporation nozzle must be selected such that a desired flow rate and cooling effect is attained using a given kind of liquefied coolant gas. For liquefied carbon dioxide, the orifice diameter is selected to be 0.08-0.09 mm. The length of flow travel through the orifice shall be relatively short, advantageously less than 0.5 mm. This is because gradual decrease of pressure in a longer orifice channel may cause plugging by frost formation in the channel. Into the coolant duct bore 25 of the plasma torch handle 18 slidingly enters a coolant inlet nipple 12 of the plasma arc nozzle 7 with a nipple OD/ID of 2.4/2.0 mm. For perfect leakproofness, the coolant inlet nipple 12 must be fit tightly into the coolant duct bore 25 of the torch handle 18 and, respectively, also the coolant outlet nipple 13 must have a tight fit. The nipples are adapted to enter the torch handle by about 3 mm. Further sealing of the construction is provided by the flat mating plane between the plasma arc nozzle 7 and the torch handle 18. Additionally, the silicone insulator 18 may enter the plasma arc nozzle by about 1 mm for improved sealing. The evaporation nozzle 24 should be located at least midway of the nipple connected to the coolant inlet duct 12 or, even more advantageously, be situated in the coolant space 3 of the plasma arc nozzle 7. However, placing the evaporation nozzle 24 into the coolant space subjects the small-diameter orifice of the evaporation nozzle to risk of damage, e.g., during change of the plasma arc nozzle.

At the sides of the plasma arc nozzle 18 are adapted springed clamps 26 made of bronze or steel that pass the current of the pilot arc to the narrow sides of the plasma arc nozzle 7. Another function of the clamps is to lock the plasma arc nozzle in place after the shield gas cup 15 has been pushed home. Flexible claws at the tips of the steel clamps 26 snap into an annular groove made to the inner periphery of the shield gas cup thus locking the shield gas cup 15 in place. The upper portion of the shield gas cup is sealed radially about the nozzle body by a depth of about 4 mm. The steel clamps also form a short-circuited loop that secures the connection of the current cable of the shield gas cup prior to the current is switched on. This feature adds to the operator's occupational safety. Via the torch handle 18 are also passed a possible powder additive and the shield gas itself via four ducts of 1.8 mm dia. at the long sides of the plasma arc nozzle.

Due to efficient cooling, the plasma torch can be operated at high current levels, even up to 100-160 A. The main arc current is passed directly to the electrode holder. The pilot arc is operated at a current level of about 3-10 A that is passed to the sides of the plasma arc nozzle.

As mentioned earlier, the plasma torch is cooled according to the invention by means of coolant phase change. A particularly preferred coolant is carbon dioxide that is available in liquefied form at a low cost. Pressurized carbon dioxide is passed via a check valve to the evaporation nozzle 24, wherein its pressure drops drastically and the coolant undergoes a phase change from liquid into gaseous form. The phase change absorbs a large amount of energy and, inasmuch as the phase change takes place in the plasma nozzle coolant space 6, the walls of the coolant space are cooled efficiently. Further advantageously, the extremely thin walls of the coolant space make heat transfer quick and efficient. Optimal design of the plasma arc nozzle and coolant gas flow paths permit full utilization of the cooling effect extractable from the evaporation of the coolant gas whereupon the outflowing gas may undergo a temperature rise as much as 50° C. that further somewhat contributes to the export of thermal energy. Still further, the temperature rise expands the gas thus naturally also binding energy into the work of expansion, but this is a minor contribution as compared with the energy of phase change. The gaseous carbon dioxide is discharged from the coolant space via the coolant outlet duct to the ambient atmosphere. Inlet pressure of the liquid coolant passed to the plasma arc nozzle and the evaporation valve 24 thereof is about 70 bar and the discharge pressure of the coolant gas is about 1 bar. While these pressure values as such are not essential to the invention, they must be selected such that inlet pressure remains sufficiently high to keep carbon dioxide in liquid form and the pressure drop rapid enough to cause evaporation. The required flow rate of coolant gas is 2 to 20 l/min of evaporated gas. Accordingly, the amount of discharged gas is not large. Obviously, the higher the welding current the larger the volumetric flow rate needed. An excessively large flow rate may cause the risk of frost build-up in the nozzle and, conversely, operation at a high current is impossible if the flow rate is adjusted too low.

In the following, some calculations are outlined exemplifying the cooling efficiency achievable by virtue of the invention.

The physical data of carbon dioxide are as follows:

heat of evaporation at 20° C.=35.1 cal/g gas density at 20° C.=1.84 g/l gas density at 50° C.=1.67 g/l conversion factor 1.163 Wh=1000 cal
conversion factor 60 min
specific heat at 0° C.=0.196 cal/g The temperature scale is degrees Celsius.

1. Energy absorbed during evaporation of carbon dioxide $$35.1\times1.84\times1.163/1000\times60=4.51\ \text{W/l}$$

2. Energy absorbed into heating the evaporated gas (20→50° C.), ΔT=30° C.

While the specific heat value is given at 0° C., it serves well as a general approximation inasmuch as it does not change essentially with the temperature rise:

$$0.196\times30\times1.67.163/1000\times60=0.69\ \text{W/l}$$

As can be seen, energy absorption into heating the gas is substantially smaller.

In tests with various combinations of evaporation nozzles, plasma arc nozzles and coolant space geometries of the plasma arc nozzles, varying temperature values of discharged coolant gas have been measured. The highest recorded temperature was 50° C. and the combination cooling effect obtained through evaporation and heating of the evaporated gas was about 5 W/l (as volumetric flow of carbon dioxide gas discharged to atmospheric pressure).

Sufficient cooling effect for practical operation at 100 A welding current has been attained using a flow rate as low as about 3 l/min producing a cooling effect of about 15 W. The maximum flow rates were 10 l/min to produce a cooling effect of 50 W. The benefit of higher flow rate is that the plasma arc nozzle can be kept cool at high welding current, yet allowing the torch tip to be kept close to the melt without complications, because the cooled plasma arc nozzle rejects the adherence of the melt and splashes thereto. Under certain conditions, however, flow rates higher than about 10-20 l/min may cause disturbance in the working environment and unnecessary waste of coolant gas. Moreover, a continuously high coolant gas flow rate may give rise to frosting of the plasma arc nozzle at low welding current levels or when the pilot arc is kept ignited alone. While the discharge flow rate of the coolant gas could be made adjustable, this facility makes the torch construction costlier.

The welding operation proper is commenced by switching on the power supply and setting on the flows of the shield gas, coolant medium and plasma gas by their respective container valves. The functions of the plasma torch can be implemented using, e.g., either one of the two methods described below. In both cases, the switch-on of the power supply initializes the control processor and turns on the no-load voltages of the pilot arc power supply and the main arc power supply, as well as pressurizes the coolant inlet hose up to the plasma torch valve 19. The plasma torch can be equipped for operation with a single control switch 16 of a dual function type. Pressing the switch 16 twice initiates the flows of the plasma gas, shield gas and coolant gas in the torch, whereupon the pilot arc is struck with the help of a high-frequency arc. Holding switch 16 continuously down further ignites the main arc and keeps it struck with the provision that the plasma arc nozzle is sufficiently close to the workpiece. As soon as the electronics of the welding equipment has detected a stable main arc, the pilot arc is extinguished. Releasing the switch 16 switches off the main arc. Hereby, the pilot arc is re-ignited and kept struck for about two minutes. If the operator during this grace period wishes to restart his work, pressing switch 16 continuously again ignites the main arc and keeps it struck. A double-click of switch 16 extinguishes both the main arc and the pilot arc, whereupon the control switch must again be pressed twice to re-strike the arcs. If the main arc has not been re-struck within two minutes from striking the pilot arc, the pilot arc is switched off and the flows of the plasma, shield and coolant gases are cut off. This function contributes to improved occupational safety inasmuch as the pilot arc then cannot unintentionally ignite a fire nor cause damage to eyes and, moreover, consumption of gases is reduced. In an alternative embodiment, the double-click function of the control switch can be implemented with the help of a second switch 17. Hence, the operation of the plasma torch is maximally uncomplicated.

In addition to those described above, the invention may have alternative embodiments.

For instance, other coolant media can be used in lieu of carbon dioxide. Inasmuch as argon is already used as the shield gas, it may as well be advantageously employed as the coolant gas, whereby the construction of the plasma torch and its auxiliary devices can possibly be simplified further. Also other inert gases such as nitrogen or helium may be contemplated as coolant media. It is further possible that the coolant is recovered and repressurized with the help of a compressor, whereby no auxiliary gases will be released to the environment. Herein, the coolant medium is preferably selected from the group of the coolant media employed and certified for use in refrigeration equipment. While this arrangement slightly complicates the plasma torch construction, the coolant need not be acquired separately in pressurized form.

In lieu of an evaporation nozzle, evaporation can be arranged to occur gradually in a pressure gradient formed in a helical intermediate passageway between the coolant space inner cone 4 and outer cone 5. Such a pressure gradient may also be accomplished by filling the coolant space with a porous material, such as sintered copper or other material of high thermal conductivity, that produces a controlled pressure gradient. Frosting causes no problems at point of the torch, since the plasma arc nozzle is subjected to continuous heat when the coolant flow is on. This embodiment, however, is hampered by the high internal pressure of the nozzle that must be taken into account by a stronger structure of the plasma torch.

The above-cited dimensions and other values are characterizing to a preferred feasible implementation of a plasma torch. Obviously, the invention is not limited to the exemplary embodiments described above.

What is claimed is:

1. A cooled plasma torch comprising:

a plasma torch handle, an electrode, a plasma chamber surrounding the electrode, a plasma gas feeding means for feeding plasma gas into the plasma chamber, a coolant space surrounding the plasma chamber with at least one common wall with the plasma chamber, a coolant feeding means for feeding a coolant medium into the coolant space separately from feeding of plasma gas into the plasma chamber, and a pressure reducing means for reducing the pressure of the coolant medium in a fashion that causes a phase change in the coolant medium as it is passed from said pressure reducing means to said coolant space, wherein said plasma torch handle incorporates at least one valve for controlling coolant medium flow to the coolant feeding means.

2. The plasma torch of claim 1, wherein said pressure reducing means is an evaporation nozzle exiting into said coolant space.

3. The plasma torch of claim 1, wherein said pressure reducing means is a channel formed into said coolant space.

4. The plasma torch of claim 1, wherein said pressure reducing means is a porous material adapted into said coolant space.

5. The plasma torch of claim 1, wherein the coolant medium is a liquefied gas that regains its gaseous form in said phase change.

6. The plasma torch of claim 5, wherein the coolant medium is carbon dioxide.

7. The plasma torch of claim 1, further comprising an electrode holder with a bore for accommodating an electrode bushing, wherein said electrode bushing is provided with a groove serving to form in cooperation with said bore a flow channel suited for passing therethrough a plasma gas into said plasma chamber.

8. The plasma torch of claim 1, comprising means for reliquefication of said coolant medium.

9. A method for cooling a plasma torch having a plasma chamber, the method comprising:

supplying plasma gas into the plasma chamber, supplying a coolant medium into a coolant space surrounding the plasma chamber of the plasma torch, the coolant medium having at least a liquid phase and a gaseous phase, feeding the coolant medium in liquid phase into the plasma torch, controlling coolant medium flow into the coolant space, and reducing the pressure of the coolant medium at the instant it enters the coolant space so much as to convert the coolant medium into gaseous form, and wherein the supplying of the coolant medium into the coolant space is separate from the supplying of the plasma gas into the plasma chamber.

10. The method of claim 9, whereby there is used a coolant medium pressurized into liquid form from its natural gaseous form at room temperature.

11. The method of claim 10, wherein the coolant medium is carbon dioxide.

12. The method of claim 9, wherein the coolant medium discharged in gaseous form is recovered and reliquefied back into liquid form by compression.

* * * * *